US010470553B1

(12) United States Patent
Gonzalez

(10) Patent No.: US 10,470,553 B1
(45) Date of Patent: Nov. 12, 2019

(54) SPORTS GEAR CARRYING ASSEMBLY

(71) Applicant: Danilo Gonzalez, Newark, CA (US)

(72) Inventor: Danilo Gonzalez, Newark, CA (US)

( * ) Notice: Subject to any disclaimer, the term of this patent is extended or adjusted under 35 U.S.C. 154(b) by 0 days.

(21) Appl. No.: 16/049,951

(22) Filed: Jul. 31, 2018

(51) Int. Cl.
*A45F 3/00* (2006.01)
*A45F 3/10* (2006.01)
*A63C 11/00* (2006.01)

(52) U.S. Cl.
CPC ..... *A45F 3/10* (2013.01); *A63C 11/00* (2013.01)

(58) Field of Classification Search
CPC ..... A45F 3/10; A63C 11/00
USPC ..... 224/201
See application file for complete search history.

(56) References Cited

U.S. PATENT DOCUMENTS 3,938,718 A * 2/1976 Madison ..... A45F 3/10 224/262
4,673,118 A * 6/1987 Kronz ..... A63C 11/025 224/259
4,819,845 A * 4/1989 Byrd ..... A63C 11/025 224/250
4,934,573 A * 6/1990 Jaeger ..... A45F 3/08 224/153
5,016,794 A 5/1991 Beagle, Jr.
5,553,759 A * 9/1996 McMaster ..... A45F 3/08 224/259
5,626,270 A * 5/1997 Tseng ..... A61M 5/1415 128/DIG. 6
6,502,732 B1 1/2003 Bonds
6,655,564 B1 * 12/2003 Zupan ..... A45F 5/12 224/259
6,857,820 B2 * 2/2005 Jacoway ..... B63C 11/02 224/627
7,568,599 B2 8/2009 Hall
7,575,138 B2 8/2009 Lindberg
7,703,645 B2 * 4/2010 Moskun ..... A45F 3/08 224/579
7,971,764 B2 7/2011 Sabbah
8,584,917 B2 * 11/2013 Hexels ..... A45F 3/08 2/102
D720,531 S 1/2015 Judson et al.
9,089,199 B1 8/2015 Taylor
9,138,631 B2 * 9/2015 Scholl ..... A45F 3/14
9,350,408 B2 * 5/2016 Cipolla ..... H04B 1/3827
(Continued)

FOREIGN PATENT DOCUMENTS

WO WO2005028041 3/2005

*Primary Examiner* — Peter N Helvey

(57) ABSTRACT

A sports gear carrying assembly includes a front plate that is worn on a user's back. The front plate has a plurality of front plate apertures extending therethrough. A back plate is coupled to the front plate and winter sports gear is positioned on the back plate. The back plate has a plurality of back plate apertures extending therethrough. An extension unit is slidably positioned between each of the front and back plates and the extension unit is laterally extendable a selected distance away from the front and back plates for accommodating a variety of widths of winter sports gear. A plurality of belts is each extended through a selected pair of the front and back plate apertures for securing the winter sports gear on the back plate. Each of the belts is matable to themselves to form a closed loop. A harness is coupled to the front plate and the harness is worn over the user's shoulders thereby facilitating the winter sports gear to be carried on the user's back.

13 Claims, 5 Drawing Sheets

(56) References Cited

U.S. PATENT DOCUMENTS

| | | | | |
|---|---|---|---|---|
| 9,961,986 | B2 * | 5/2018 | Dieguez | A45F 3/04 |
| 2003/0000974 | A1 * | 1/2003 | McUmber | A45F 3/10<br>224/155 |
| 2003/0173382 | A1 * | 9/2003 | Robinson | A45F 3/14<br>224/259 |
| 2006/0266781 | A1 * | 11/2006 | Howell | A45F 3/08<br>224/628 |
| 2009/0145787 | A1 * | 6/2009 | Grander | A45F 3/04<br>206/315.6 |
| 2009/0206118 | A1 * | 8/2009 | Sabbah | A45C 13/02<br>224/652 |
| 2010/0176172 | A1 * | 7/2010 | Gleason, Jr. | A45F 3/08<br>224/635 |
| 2011/0180575 | A1 * | 7/2011 | Abramowitz | A45C 15/00<br>224/259 |
| 2012/0292353 | A1 * | 11/2012 | Andersen | A45F 3/06<br>224/149 |

* cited by examiner

SPORTS GEAR CARRYING ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to carrying devices and more particularly pertains to a new carrying device for carrying winter sports gear in a hands free fashion.

BRIEF SUMMARY OF THE INVENTION

An embodiment of the disclosure meets the needs presented above by generally comprising a front plate that is worn on a user's back. The front plate has a plurality of front plate apertures extending therethrough. A back plate is coupled to the front plate and winter sports gear is positioned on the back plate. The back plate has a plurality of back plate apertures extending therethrough. An extension unit is slidably positioned between each of the front and back plates and the extension unit is laterally extendable a selected distance away from the front and back plates for accommodating a variety of widths of winter sports gear. A plurality of belts is each extended through a selected pair of the front and back plate apertures for securing the winter sports gear on the back plate. Each of the belts is matable to themselves to form a closed loop. A harness is coupled to the front plate and the harness is worn over the user's shoulders thereby facilitating the winter sports gear to be carried on the user's back.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
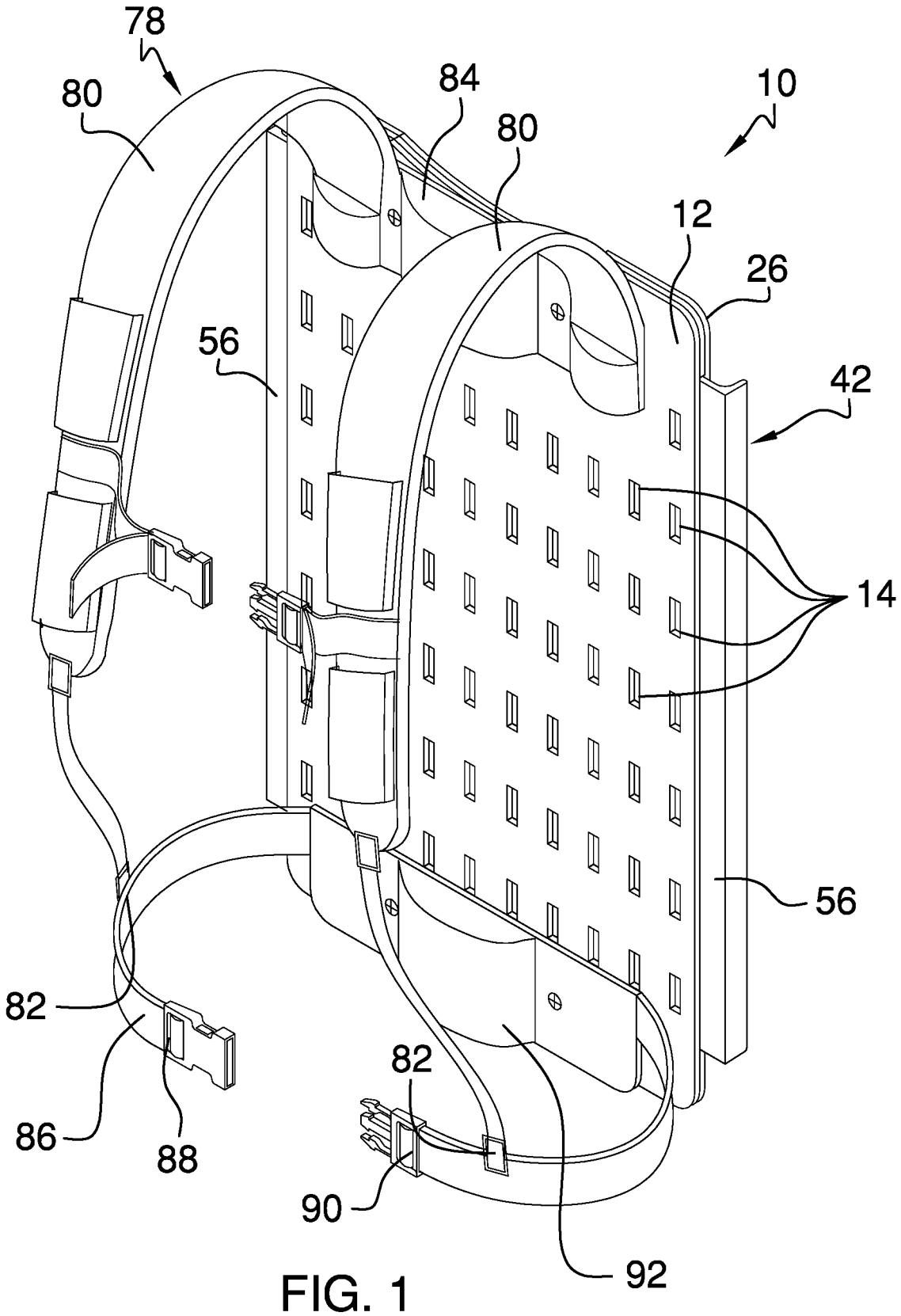
FIG. 1 is a front perspective view of a sports gear carrying assembly according to an embodiment of the disclosure.
Figure 2:
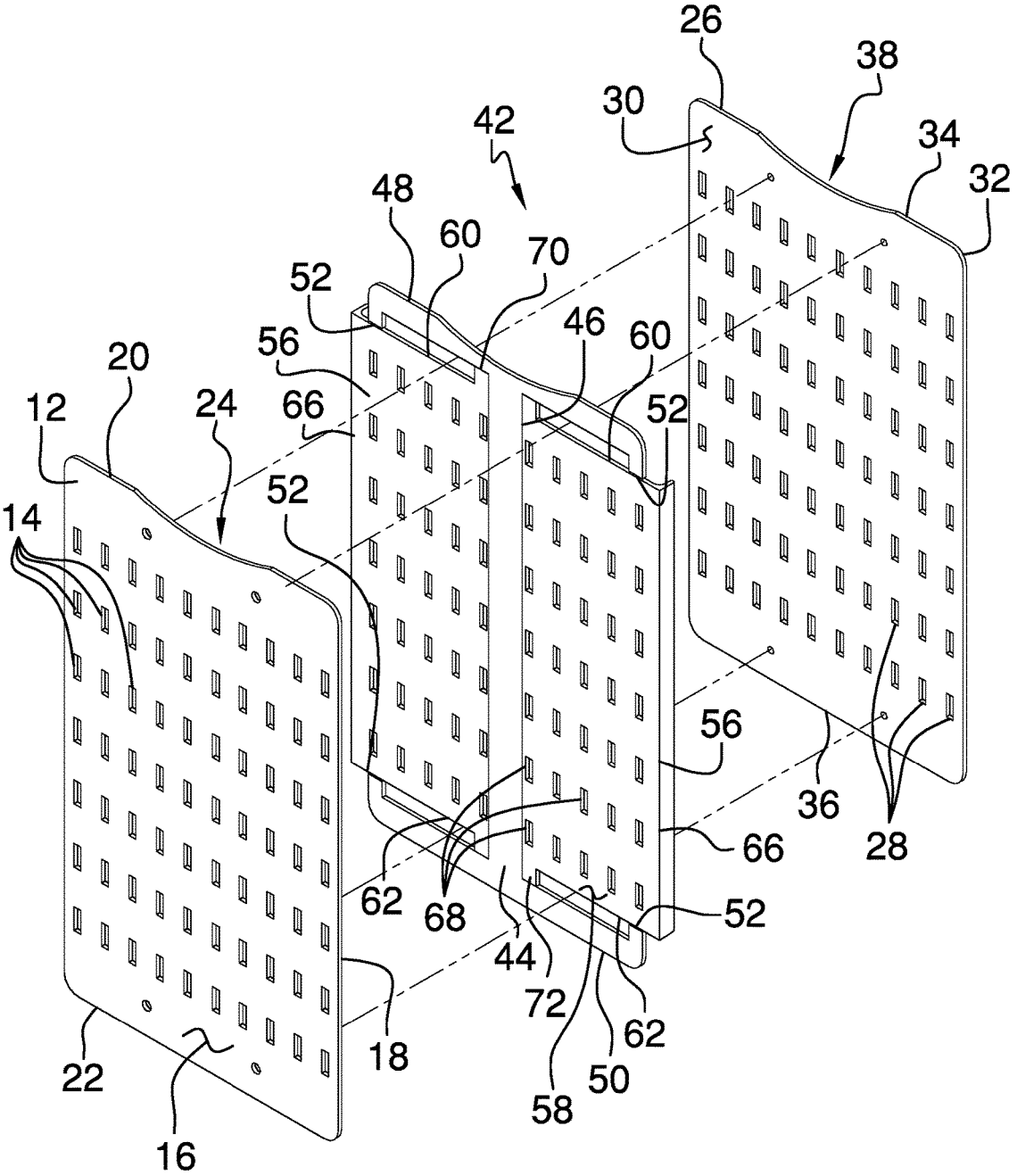
FIG. 2 is an exploded perspective view of an embodiment of the disclosure.
Figure 3:
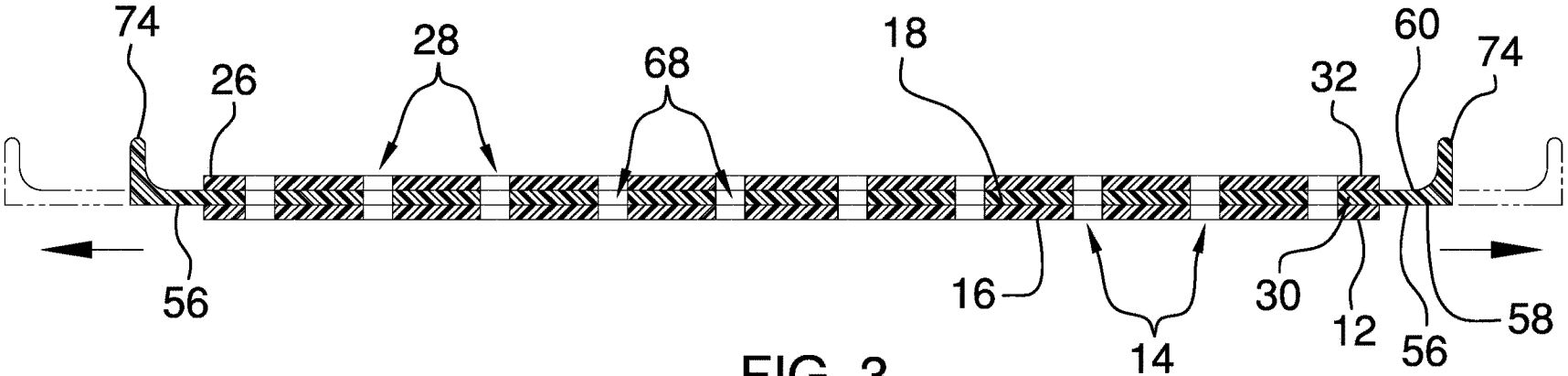
FIG. 3 is a cross sectional view taken along line 3-3 of FIG. 4 of an embodiment of the disclosure.
Figure 4:
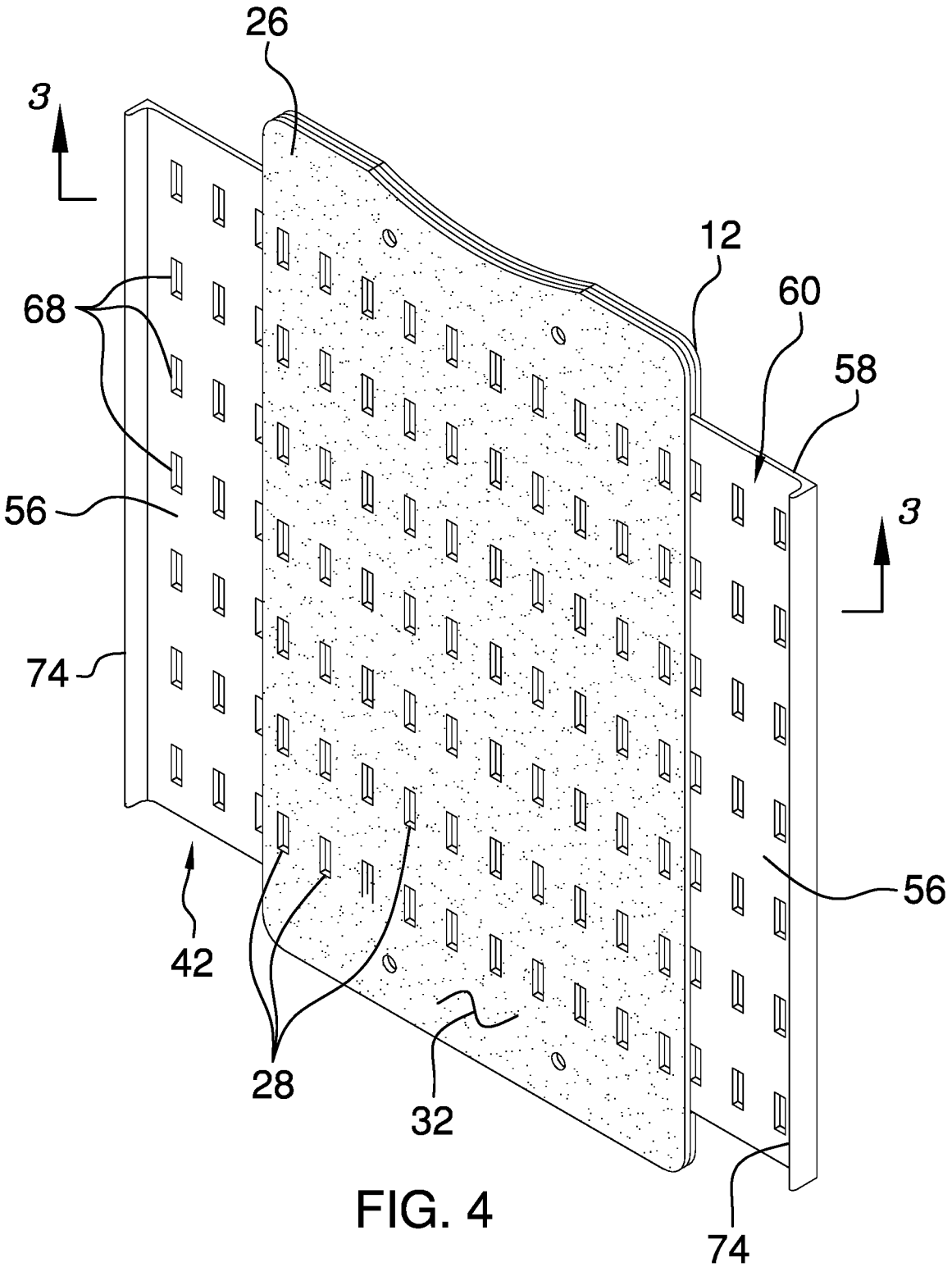
FIG. 4 is a back perspective view of an embodiment of the disclosure.
Figure 5:
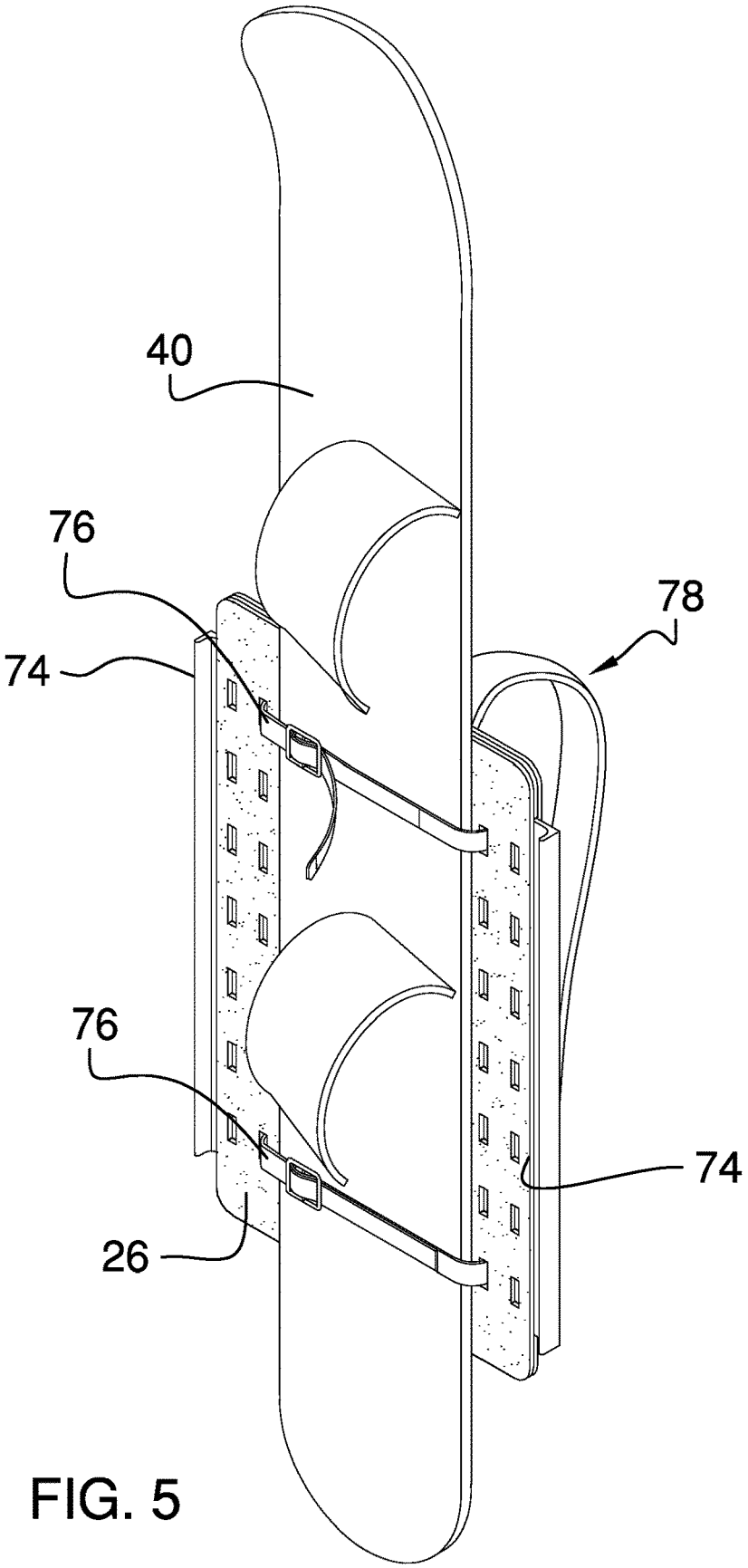
FIG. 5 is a perspective in-use view of an embodiment of the disclosure.

With reference now to the drawings, and in particular to FIGS. 1 through 5 thereof, a new carrying device embodying the principles and concepts of an embodiment of the disclosure and generally designated by the reference numeral 10 will be described.

As best illustrated in FIGS. 1 through 5, the sports gear carrying assembly 10 generally comprises a front plate 12 that is worn on a user's back. The front plate 12 has a plurality of front plate apertures 14 extending therethrough, and the plurality of front plate apertures 14 are arranged into a plurality of columns and rows on the front plate 12. The front plate 12 has a front surface 16, a back surface 18, a top edge 20 and a bottom edge 22, and each of the front plate apertures 14 extends through the front 16 and back 18 surfaces. The top edge 20 has a scallop 24 extending downwardly therein for accommodating a user's neck when the front plate 12 is worn on the user's back.

A back plate 26 is coupled to the front plate 12 and the back plate 26 has a plurality of back plate apertures 28 extending therethrough. The plurality of back plate apertures 28 are arranged into a plurality of columns and rows on the back plate 26 and each of the back plate apertures 28 is aligned with a respective one of the front plate apertures 14. The back plate 26 has a forward surface 30, a rearward surface 32, an upper edge 34 and a lower edge 36, and each of the back plate apertures 28 extends through the forward 30 and rearward 32 surfaces. The upper edge 34 has a scallop 38 extending downwardly therein for accommodating the user's neck. Winter sports gear 40, such as a snow board, snow skis or other elongated winter sports gear 40, is positioned on the rearward surface 32 of the back plate 26. Moreover, the rearward surface 32 is textured for frictionally engaging the winter sports gear 40.

An extension unit 42 is slidably positioned between each of the front 12 and back 26 plates. The extension unit 42 is laterally extendable a selected distance away from the front 12 and back 26 plates for accommodating a variety of widths of winter sports gear 40. The extension unit 42 is manipulated laterally compress the winter sports gear 40 to reduce movement of the winter sports gear 40 on the back plate 26.

The extension unit 42 comprises a frame 44 that has a central member 46 extending between an upper member 48 and a lower member 50. The central member 46 is oriented perpendicular to and is centrally positioned on each of the upper 48 and lower 50 members such that the frame 44 defines an I shape.

Each of the upper 48 and lower 50 members has a pair of feet 52 extending away therefrom. The feet 52 on each of the upper 48 and lower 50 members is spaced from the central member 46 to define a space 54 between the central member 46 and the feet 52 on each of the upper 48 and lower 50 members. Additionally, the feet 52 on the upper member 48 are directed toward the feet 52 on the lower member 50. The frame 44 is positioned between the front 12 and back 26 plates having the central member 46 being vertically oriented between the front 12 and back 26 plates. Additionally, the upper member 48 is aligned with the top edge 20 of the front plate 12 and the upper edge 34 of the back plate 26, and the lower member 50 is aligned with the bottom edge 22 of the front plate 12 and the lower edge 36 of the back plate 26.

The extension unit 42 includes a pair of extension panels 56 that each has a first surface 58, a second surface 60, a top edge 62, a bottom edge 64 and a first lateral edge 66. Each of the extension panels 56 has a plurality of extension apertures 68 extending through the first 58 and second 60 surfaces. The extension apertures 68 on each of the extension panels 56 are arranged into a plurality of columns and rows on the extension panels 56. Additionally, the top edge 62 of each of the extension panels 56 has an upper tab 70 extending upwardly therefrom and the bottom edge 22 of each of the extension panels 56 has a lower tab 72 extending downwardly therefrom. Each of the upper 70 and lower 72 tabs on each of the extension panels 56 is positioned in the space 54 such that each of the upper 70 and lower 72 tabs on each of the extension panels 56 can travel along the space 54.

A pair of lips 74 is each coupled to and extends away from the first surface 58 of a respective one of the extension panels 56. Each of the lips 74 is aligned with and is coextensive with the first lateral edge 66 of the respective extension panel 56. Each of the lips 74 is spaced a minimum distance from the front 12 and back 26 plates when the extension panels 56 are positioned in a minimum position for accommodating winter sports gear 40 with a minimum width. Additionally, each of the lips 74 is spaced a maximum distance front the front 12 and back 26 plates when the extension panels 56 are positioned in a maximum position for accommodating winter sports gear 40 with a maximum width. Each of the upper 70 and lower 72 tabs on the extension panels 56 abuts a respective one of the feet 52 when the extension panels 56 are positioned in the maximum position. In this way the extension panels 56 are inhibited from being removed from between the front 12 and back 26 plates.

A plurality of belts 76 is each extended through a selected pair of the front 14 and back 28 plate apertures for securing the winter sports gear 40 on the back plate 26. Each of the belts 76 is matable to themselves to form a closed loop. The belts 76 may be matable together with a complementary set of buckles or any other conventional means of releasably mating a belt to itself. A harness 78 is coupled to the front plate 12 and the harness 78 is worn over the user's shoulders thereby facilitating the winter sports gear 40 to be carried on the user's back.

The harness 78 comprises a pair of shoulder straps 80 that is each coupled to the front surface 16 of the front plate 12. Each of the shoulder straps 80 has a distal end 82 with respect to the front plate 12. An upper cushion 84 is coupled to the front surface 16 of the front plate 12 such that the upper cushion 84 engages the user's back when the front plate 12 is worn on the user's back. The upper cushion 84 extends between each of the shoulder straps 80.

A waist strap 86 is coupled to the front surface 16 of the front plate 12 and the waist strap 86 is worn around the user's waist when the front plate 12 is worn on the user's back. The distal end 82 of each of the shoulder straps 80 is coupled to the waist strap 86. The waist strap 86 has a first end 88 and a second end 90, and the first 88 and second 90 ends are matable together such that the waist strap 86 forms a closed loop around the user's waist. The waist strap 86 may be matable to itself with a pair of complementary buckles or any other conventional means of mating a strap to itself. A lower cushion 92 is coupled to the front surface 16 of the front plate 12 such that the lower cushion 92 engages the user's back when the front plate 12 is worn on the user's back. The lower cushion 92 is aligned with the waist strap 86.

In use, the winter sports gear 40 is positioned on the back plate 26 and each of the belts 76 is extended through the front plate 12, the back plate 26 and extension panels 56 to attach the winter sports gear 40 to the back plate 26. Each of the shoulder straps 80 is worn over the user's shoulders and the waist strap 86 is worn around the user's waist. In this way the winter sports gear 40 may be carried on the user's back for riding a bus, holding drinks or accomplishing any task that requires the user to have two free hands. The extension panels 56 are extendable to a selected width for accommodating especially wide winter sports gear 40 thereby facilitating the lips 74 to laterally restrain the especially wide winter sports gear 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sports gear carrying assembly being configured for carrying winter sports equipment on a user's back, said assembly comprising:

a front plate being worn on a user's back, said front plate having a plurality of front plate apertures extending therethrough, said plurality of front plate apertures being arranged into a plurality of columns and rows on said front plate;

a back plate being coupled to said front plate, said back plate having winter sports gear being positioned thereon, said back plate having a plurality of back plate apertures extending therethrough, said plurality of back plate apertures being arranged into a plurality of columns and rows on said back plate, each of said back plate apertures being aligned with a respective one of said front plate apertures;

an extension unit being slidably positioned between each of said front and back plates, said extension unit being laterally extendable a selected distance away from said front and back plates for accommodating a variety of widths of winter sports gear;

a plurality of belts, each of said belts being extended through a selected pair of said front and back plate apertures for securing the winter sports gear on said back plate, each of said belts being matable to themselves to form a closed loop; and a harness being coupled to said front plate, said harness being worn over the user's shoulders thereby facilitating the winter sports gear to be carried on the user's back.

2. The assembly according to claim 1, wherein:

said front plate having a front surface, a back surface, a top edge and a bottom edge, each of said front plate apertures extending through said front and back surfaces;

said top edge having a scallop extending downwardly therein for accommodating a user's neck when said front plate is worn on the user's back;

said back plate has a forward surface, a rearward surface, an upper edge and a lower edge, each of said back plate apertures extending through said forward and rearward surfaces;

said upper edge having a scallop extending downwardly therein for accommodating the user's neck; and said rearward surface having winter sports gear being positioned thereon, said rearward surface being textured for frictionally engaging the winter sports gear.

3. The assembly according to claim 2, wherein said extension unit includes a frame having a central member extending between an upper member and a lower member, said central member being oriented perpendicular to and being centrally positioned on each of said upper and lower members such that said frame defines an I shape.

4. The assembly according to claim 3, wherein each of said upper and lower members has a pair of feet extending away therefrom, said feet on each of said upper and lower members being spaced from said central member to define a space between said central member and said feet on each of said upper and lower members, said feet on said upper and lower members being directed toward each other.

5. The assembly according to claim 4, wherein said frame is positioned between said front and back plates having said central member being vertically oriented between said front and back plates, said upper member being aligned with said top edge of said front plate and said upper edge of said back plate, said lower member being aligned with said bottom edge of said front plate and said lower edge of said back plate.

6. The assembly according to claim 5, wherein said extension unit further includes a pair of extension panels, each of said extension panels having a first surface, a second surface, a top edge, a bottom edge and a first lateral edge, each of said extension panels having a plurality of extension apertures extending through said first and second surfaces, said extension apertures on each of said extension panels being arranged into a plurality of columns and rows on said extension panels.

7. The assembly according to claim 6, wherein said top edge of each of said extension panels has an upper tab extending upwardly therefrom, said bottom edge of each of said extension panels having a lower tab extending downwardly therefrom, each of said upper and lower tabs on each of said extension panels being positioned in said space such that each of said upper and lower tabs on each of said extension panels can travel along said space.

8. The assembly according to claim 7, further comprising a pair of lips, each of said lips is coupled to and extends away from said first surface of a respective one of said extension panels, each of said lips being aligned with and being coextensive with said first lateral edge of said respective extension panel, each of said lips being spaced a minimum distance from said front and back panels when said extension panels are positioned in a minimum position for accommodating winter sports gear with a minimum width, each of said lips being spaced a maximum distance front said front and back panels when said extension panels are positioned in a maximum position for accommodating winter sports gear with a maximum width.

9. The assembly according to claim 2, wherein said harness comprises a pair of shoulder straps, each of said shoulder straps being coupled to said front surface of said front plate, each of said shoulder straps having a distal end with respect to said front plate.

10. The assembly according to claim 9, further comprising an upper cushion being coupled to said front surface of said front plate such that said upper cushion engages the user's back when said front plate is worn on the user's back, said upper cushion extending between each of said shoulder straps.

11. The assembly according to claim 10, further comprising a waist strap being coupled to said front surface of said front plate, said waist strap being worn around the user's waist when said front plate is worn on the user's back, said distal end of each of said shoulder straps being coupled to said waist strap, said waist strap having a first end and a second end, said first and second ends being matable together such that said waist strap forms a closed loop around the user's waist.

12. The assembly according to claim 11, further comprising a lower cushion being coupled to said front surface of said front plate such that said lower cushion engages the user's back when said front plate is worn on the user's back, said lower cushion being aligned with said waist strap.

13. A sports gear carrying assembly being configured for carrying winter sports equipment on a user's back, said assembly comprising:

a front plate being worn on a user's back, said front plate having a plurality of front plate apertures extending therethrough, said plurality of front plate apertures being arranged into a plurality of columns and rows on said front plate, said front plate having a front surface, a back surface, a top edge and a bottom edge, each of said front plate apertures extending through said front and back surfaces, said top edge having a scallop extending downwardly therein for accommodating a user's neck when said front plate is worn on the user's back;

a back plate being coupled to said front plate, said back plate having a plurality of back plate apertures extending therethrough, said plurality of back plate apertures being arranged into a plurality of columns and rows on said back plate, each of said back plate apertures being aligned with a respective one of said front plate apertures, said back plate having a forward surface, a rearward surface, an upper edge and a lower edge, each of said back plate apertures extending through said forward and rearward surfaces, said upper edge having a scallop extending downwardly therein for accommodating the user's neck, said rearward surface being textured for frictionally engaging the winter sports gear, said rearward surface having winter sports gear being positioned thereon;

an extension unit being slidably positioned between each of said front and back plates, said extension unit being laterally extendable a selected distance away from said front and back plates for accommodating a variety of widths of winter sports gear, said extension unit comprising:

a frame having a central member extending between an upper member and a lower member, said central member being oriented perpendicular to and being centrally positioned on each of said upper and lower members such that said frame defines an I shape, each of said upper and lower members having a pair of feet extending away therefrom, said feet on each of said upper and lower members being spaced from said central member to define a space between said central member and said feet on each of said upper and lower members, said feet on said upper and lower members being directed toward each other, said frame being positioned between said front and back plates having said central member being vertically oriented between said front and back plates, said upper member being aligned with said top edge of said front plate and said upper edge of said back plate, said lower member being aligned with said bottom edge of said front plate and said lower edge of said back plate;

a pair of extension panels, each of said extension panels having a first surface, a second surface, a top edge, a bottom edge and a first lateral edge, each of said extension panels having a plurality of extension apertures extending through said first and second surfaces, said extension apertures on each of said extension panels being arranged into a plurality of columns and rows on said extension panels, said top edge of each of said extension panels having an upper tab extending upwardly therefrom, said bottom edge of each of said extension panels having a lower tab extending downwardly therefrom, each of said upper and lower tabs on each of said extension panels being positioned in said space such that each of said upper and lower tabs on each of said extension panels can travel along said space; and a pair of lips, each of said lips being coupled to and extending away from said first surface of a respective one of said extension panels, each of said lips being aligned with and being coextensive with said first lateral edge of said respective extension panel, each of said lips being spaced a minimum distance from said front and back panels when said extension panels are positioned in a minimum position for accommodating winter sports gear with a minimum width, each of said lips being spaced a maximum distance front said front and back panels when said extension panels are positioned in a maximum position for accommodating winter sports gear with a maximum width;

a plurality of belts, each of said belts being extended through a selected pair of said front and back plate apertures for securing the winter sports gear on said back plate, each of said belts being matable to themselves to form a closed loop; and a harness being coupled to said front plate, said harness being worn over the user's shoulders thereby facilitating the winter sports gear to be carried on the user's back, said harness comprising:

a pair of shoulder straps, each of said shoulder straps being coupled to said front surface of said front plate, each of said shoulder straps having a distal end with respect to said front plate;

an upper cushion being coupled to said front surface of said front plate such that said upper cushion engages the user's back when said front plate is worn on the user's back, said upper cushion extending between each of said shoulder straps;

a waist strap being coupled to said front surface of said front plate, said waist strap being worn around the user's waist when said front plate is worn on the user's back, said distal end of each of said shoulder straps being coupled to said waist strap, said waist strap having a first end and a second end, said first and second ends being matable together such that said waist strap forms a closed loop around the user's waist; and a lower cushion being coupled to said front surface of said front plate such that said lower cushion engages the user's back when said front plate is worn on the user's back, said lower cushion being aligned with said waist strap.

* * * * *